US006783611B2

(12) United States Patent
Yajima et al.

(10) Patent No.: US 6,783,611 B2
(45) Date of Patent: Aug. 31, 2004

(54) PHOSPHORIZED COPPER ANODE FOR ELECTROPLATING

(75) Inventors: Kenji Yajima, Saitama (JP); Akihiro Kakimoto, Osaka (JP); Hideyuki Ikenoya, Iwaki (JP)

(73) Assignee: Mitsubishi Materials Corporation, Tokyo (JP)

( * ) Notice: Subject to any disclaimer, the term of this patent is extended or adjusted under 35 U.S.C. 154(b) by 135 days.

(21) Appl. No.: 10/095,050

(22) Filed: Mar. 12, 2002

(65) Prior Publication Data

US 2003/0029527 A1 Feb. 13, 2003

(30) Foreign Application Priority Data

Mar. 13, 2001 (JP) ..... P2001-069848

(51) Int. Cl.[7] ..... C22C 9/00

(52) U.S. Cl. ..... 148/432; 148/433; 148/434; 148/435; 148/436

(58) Field of Search ..... 148/432, 433, 148/434, 435, 436; 420/499

(56) References Cited

FOREIGN PATENT DOCUMENTS

| | | | |
|---|---|---|---|
| JP | 02019432 | * | 1/1990 |
| JP | 04231430 | * | 8/1992 |
| JP | 04231446 | * | 8/1992 |
| JP | 08-067932 | | 3/1996 |
| JP | 09302427 | * | 11/1997 |
| JP | 11222641 | * | 8/1999 |

* cited by examiner

*Primary Examiner*—Sikyin Ip

(57) ABSTRACT

A phosphorized copper anode used for electroplating, including: 20–800 ppm of phosphorus; between 0.1 and less than 2 ppm of oxygen, and the balance being high purity copper having a purity of 99.9999% by mass or higher, wherein the average grain size of the copper anode after recrystallization is in the range between about 10 and 50 $\mu$m.

1 Claim, No Drawings

PHOSPHORIZED COPPER ANODE FOR ELECTROPLATING

BACKGROUND OF THE INVENTION

1. Field of the Invention

The present invention relates to a phosphorized copper anode used for electroplating, by the use of which particles are not attached to or generated on a plating surface of a cathode. More specifically, the present invention relates to a phosphorized copper anode used for electroplating in order to form a copper wiring for a semiconductor device.

2. Description of Related Art

In general, it is known that a phosphorized copper anode may be used as an anode for electroplating copper. As an example of a phosphorized copper anode for electroplating, one which includes 350–700 ppm of phosphorus and 2–5 ppm of oxygen, besides copper and inevitable impurities, is known as disclosed in Japanese Unexamined Patent Application, First Publication No. Hei 8-67932.

This conventional phosphorized copper anode for electroplating is used for plating copper on a drum for gravure printing. The copper anode is manufactured by: preparing electrolytic copper having a purity of more than 99.99%; dissolving the electrolytic copper in a shaft kiln under a $CO+N_2$ atmosphere; supplying the resultant molten metal to a holding furnace; adding phosphorus to the molten metal in the holding furnace; immediately casting the molten metal to form an ingot of a predetermined size; removing a top portion of the ingot and subjecting the ingot to a forging process; and cutting the ingot to a predetermined size after carrying out a facing process thereon. The phosphorized copper anode for electroplating produced in this manner has a processed structure.

On the other hand, aluminum alloys have been used as a wiring material for semiconductor devices for a long time.

These days, however, from the viewpoint of decreasing the size of semiconductor devices and increasing the density thereof, copper, whose resistivity is lower than that of aluminum by almost 40%, is used for a wiring material for semiconductor devices instead of aluminum alloys. However, if wiring is formed on a semiconductor device by means of a copper plating method using a conventional phosphorized copper anode, a black film-like substance is formed on the surface of the copper anode, becomes separated from the anode surface during the electroplating process, and is left floating in the plating bath. It is now understood that a part of the black film-like substance attaches onto a copper thin film, which is formed on the silicon wafer surface of the cathode side and becomes copper wiring by the electroplating process, as a particle and causes problems.

The inventors of the present invention, in consideration of the above problems, carried out diligent studies to obtain a phosphorized copper anode for electroplating, by the use of which particles do not become attached to the surface of a copper thin membrane when wiring is formed on a semiconductor device by means of copper plating.

As a result, the inventors of the present invention found that, as compared with a conventional anode, if a phosphorized copper anode for electroplating is prepared while decreasing the oxygen content thereof to a level between 0.1 ppm or greater and less than 2 ppm, making the structure thereof a fine recrystallized structure, and adjusting the average grain size thereof after recrystallization to fall in the range between about 10–50 μm, then there is very little separation of the black film-like substance from the surface of the copper anode on which it is formed during the electroplating process when the resultant copper anode is used for forming copper wiring by means of electroplating. Accordingly, it was also found that when copper wiring is formed on a semiconductor device by using the phosphorized copper anode for electroplating, there is almost no attachment or generation of particles on the copper wiring.

SUMMARY OF THE INVENTION

The present invention was completed based on the above findings and has an object to provide a phosphorized copper anode for electroplating comprising: 20–800 ppm of phosphorus, between 0.1 and less than 2 ppm of oxygen, and the balance being high purity copper of 99.9999% by mass or higher, wherein the average grain size of the anode after recrystallization is in the range between about 10 and 50 lm.

If the amount of phosphorus contained in the copper anode for electroplating is less than 20 ppm, copper particles may be generated during the electroplating process, which is not preferred. In such contrast, if the content of phosphorus is greater than 800 ppm, it is also not preferable since its electric conductivity is decreased, and the electric energy loss is increased. Thus, the content of phosphorus in the phosphorized copper anode for electroplating according to the present invention is determined to be between 20 and 800 ppm. Moreover, the amount of phosphorus contained in the copper anode for electroplating according to the present invention is preferably in the range between about 250 and 550 ppm.

On the other hand, although it is preferable that the amount of oxygen contained in the phosphorized copper anode for electroplating be as low as possible according to the present invention, it is economically inefficient to decrease the amount of oxygen to be less than 0.1 ppm. On the other hand, if the amount of oxygen is 2 ppm or greater, it is not preferable because the black film-like substance formed on the surface of the phosphorized copper anode tends to be easily separated. Thus, the amount of oxygen contained in the phosphorized copper anode for electroplating is determined to be between 0.1 ppm or greater and less than 2 ppm. The amount of oxygen contained in the phosphorized copper anode for electroplating is preferably in the range between about 0.4 and 1.2 ppm.

The structure and the grain size of the phosphorized copper anode for electroplating greatly affect the separation of the black film formed during an electroplating process. It is preferable that the structure of the phosphorized copper anode for electroplating according to an embodiment of the present invention be a recrystallized structure. The smaller the grain size thereof, the more preferable it is. However, it costs too much to make the average grain size after recrystallization less than 10 μm, and hence, it is economically not preferred. On the other hand, if the average grain size after recrystallization exceeds 50 μm, the black film-like substance formed on the surface of the phosphorized copper anode tends to become separated, which is not preferable. Accordingly, the average grain size after recrystallization of the phosphorized copper anode for electroplating according to an embodiment of the present invention is determined to be in the range between about 10 and 50 μm. It is preferable that the average grain size after recrystallization of the phosphorized copper anode for electroplating be in the range between about 15 and 35 μm.

It is preferable that the phosphorized copper anode for electroplating according to an embodiment of the present invention be constructed using electrolytic copper having a purity of more than 99.9999%. This is because if the copper anode is constructed by using electrolytic copper having a purity of more than 99.9999%, the tendency for the black film to become separated therefrom is significantly reduced as compared with the case where a copper anode is constructed using electrolytic copper having a purity of more than 99.99%.

The phosphorized copper anode for electroplating according to an embodiment of the present invention may be constructed by: preparing electrolytic copper having a purity of more than 99.9999%; placing the electrolytic copper into a carbon crucible; dissolving the electrolytic copper under an inert or reduced gas atmosphere having a dew point of −10° C. or lower; adding phosphorus to the resultant molten metal and casting the molten metal at a temperature between 1150 and 1300° C. to form an ingot of a predetermined size; removing a top portion of the ingot and applying heat; subjecting the ingot to a forging process and carrying out a cold rolling process to 20–80% draft; applying heat in the range between about 300 and 500° C. for about 20 minutes to 4 hours so as to adjust the average grain size after crystallization to be in the range between about 10 and 50 μm; and cutting to a predetermined size after carrying out a facing process.

DETAILED DESCRIPTION OF THE INVENTION

The invention summarized above and defined by the enumerated claims may be better understood by referring to the following detailed description. This detailed description of a particular preferred embodiment, set out below to enable one to build and use one particular implementation of the invention, is not intended to limit the enumerated claims, but to serve as a particular example thereof.

An ingot having a diameter of 140 mm and a length of 240 mm was produced by: preparing electrolytic copper having a purity of more than 99.9999%; placing the electrolytic copper into a carbon crucible to dissolve it in a high frequency induction heater under a $CO+N_2$ mixed gas atmosphere having a dew point of −10° C. or lower; adding granules of red phosphorus, which are wrapped in a pure copper sheet, in order to add phosphorus to the resultant molten metal while maintaining a temperature of 1250° C.; immediately casting the molten metal under a $CO+N_2$ mixed gas atmosphere having a dew point of −10° C. or lower to produce an ingot having a diameter of 140 mm and a length of 270 mm; and removing a top portion of the ingot. Note that a Cu—P alloy may be used instead of the granules of red phosphorus in order to add phosphorus to the ingot.

Then, a forging having a processed structure and a diameter of 150 mm and a length of 210 mm was produced by heating the obtained ingot to a temperature of about 600° C., hammering and stretching the ingot, compressing the ingot from the direction in which the ingot has been stretched, and repeating this forging process three times. The obtained forging was cut to a predetermined size and the surface thereof was subjected to a facing process. After carrying out a cold rolling process to 50% draft, the forging was maintained at a temperature in the range between about 300 and 500° C. for about 20 minutes to 4 hours to carry out a strain removing annealing process causing recrystallization and resulting in the average grain size after recrystallization shown in Table 1. Then, the forging was ground to a level of 1000# after a facing process, and was subsequently subjected to a degreasing process to obtain phosphorized copper anodes of 1–9 according to embodiments of the present invention and comparative phosphorized copper anodes of 1–4 shown in Table 1. Further, the average grain size after recrystallization of the phosphorized copper anodes 1–9 according to the embodiments of the present invention and that of the comparative phosphorized copper anodes 1–4 were measured and the results are tabulated in Table 1.

In addition, in order to make a comparison, the above-mentioned forging was cut without being subjected to cold rolling, and then subjected to a facing process and a grinding process to a level of 1000#. Then, without carrying out a degreasing process, a conventional phosphorized copper anode having a processed structure and the compositions shown in Table 1 was prepared.

Note that the average grain size after recrystallization of the phosphorized copper anodes 1–9 according to the embodiments of the present invention and that of the comparative phosphorized copper anodes 1–4 after recrystallization were measured based on JISH 0501.

Then, a plating bath including an aqueous solution, in which the following compositions were added, was prepared, and its temperature was maintained at 25° C.:

| | |
|---|---|
| $CuSO_4$ | 30 g/l |
| $H_2SO_4$ | 180 g/l |
| Bis(3-sulfopropyl)disulfide | 1 mg/l |
| Janus green B | 1 mg/l |
| Polyethylene glycol | 300 mg/l |
| Chlorine ions | 50 mg/l |

Also, a single crystal Si plate having a size of 150 mm (length)×50 mm (width)×1 mm (thickness), on which a Cu thin membrane having a thickness of 0.1 μm was formed, was prepared and used as a cathode.

The above plating bath was filled in a transparent container and the phosphorized copper anodes 1–9 according to the embodiments of the present invention, the comparative phosphorized copper anodes 1–4, and the conventional phosphorized copper anode were immersed in the plating bath. Also, the above mentioned cathode was immersed in the plating bath and separated from the anode by a distance of 50 mm. Then, a direct current having a current density of 1 $A/dm^2$ was applied for 9 minutes while the plating bath was stirred to form a copper plating membrane having a thickness of about 30 μm.

While the above electroplating process was conducted, the generation of a black film-like substance on the anode was visually observed through the transparent container, and the results are shown in Table 1. In Table 1, ◎ indicates no separation of the black film-like substance in a stable manner, ○ indicates repeating of partial generation and separation of the black film-like substance, Δ indicates occasional separation of the black film-like substance, and × indicates the generation of copper particles. Further, after the termination of the electroplating process, the cathodes were washed using pure water, and the center portion and the end portion thereof were observed under an optical microscope with a 10 mm×10 mm visual field and 100 X magnification to count the number of particles larger than 5 μm which were attached to the cathode. The results are also shown in Table 1.

TABLE 1

| Anode including phosphorus | | Composition (ppm) P | O | **Cu | Average grain size (μm) | Black film attachment | No. of particles attached to cathode |
|---|---|---|---|---|---|---|---|
| Anodes of the present invention | 1 | 480 | 0.4 | Balance | 25 | ◎ | 0 |
| | 2 | 150 | 1.6 | Balance | 40 | ◎ | 0 |
| | 3 | 50 | 0.6 | Balance | 45 | ◎ | 0 |
| | 4 | 650 | 0.5 | Balance | 15 | ◎ | 0 |
| | 5 | 180 | 1.2 | Balance | 10 | ◎ | 0 |
| | 6 | 290 | 0.2 | Balance | 34 | ◎ | 0 |
| | 7 | 750 | 0.8 | Balance | 28 | ◎ | 0 |
| | 8 | 350 | 1.4 | Balance | 21 | ◎ | 0 |
| | 9 | 520 | 1.8 | Balance | 30 | ◎ | 0 |
| Comparative anodes | 1 | *850 | 0.4 | Balance | 25 | Δ | 8 |
| | 2 | *15 | 1.7 | Balance | 25 | X | 40 |
| | 3 | 400 | *5.1 | Balance | 40 | X | 12 |
| | 4 | 350 | 1.3 | Balance | *65 | ○ | 15 |
| Conventional | | 420 | *3.6 | Balance | Processed structure | Δ | 77 |

*indicates a value which does not fall into the scope of the present invention
**Cu indicates copper having a purity of 99.9999% or higher As is obvious from the results shown in Table 1, when the electroplating process was performed using the phosphorized copper anodes 1–9 according to the embodiments of the present invention, the attachment of particles larger than 51 μm was not observed on the surface of the plating layer of the cathode. However, when the conventional phosphorized copper anode was used, a relatively large number of particles larger than 5 μm were attached to the plating surface. Moreover, when the comparative phosphorized copper anodes 1–4, each of which had an element whose value was outside the scope of the present invention, were used for the electroplating process, a relatively large number of particles larger than 5 μm were also attached to the plating surface.

Accordingly, as explained above, since no particles larger than 5 μm were attached to the plating layer which was formed using the phosphorized copper anode according to the embodiments of the invention, the present invention is especially suitable for use in forming copper wiring on a semiconductor device by electroplating. By using the present invention in this manner, industrially superior effects may be brought about, and it becomes possible to decrease the number of defective products and improve productivity.

Having thus described an exemplary embodiment of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A phosphorized copper anode used for electroplating, consisting essentially of:

20–800 ppm of phosphorus;

between 0.1 and 1.8 ppm of oxygen, and the balance being high purity copper having a purity of 99.9999% by mass or higher, wherein the average grain size of said copper anode after recrystallization is in the range between about 10 and 50 μm.

* * * * *